US012448881B2

(12) United States Patent
Hill et al.

(10) Patent No.: US 12,448,881 B2
(45) Date of Patent: Oct. 21, 2025

(54) DOWNHOLE MONITORING OF HYDRAULIC EQUIPMENT

(71) Applicant: Schlumberger Technology Corporation, Sugar Land, TX (US)

(72) Inventors: Steven Nicholas Hill, Houston, TX (US); Darcio Aparecido Braga, Fulshear, TX (US); Geoffrey Pinard, Missouri City, TX (US); Mannix Flores-Cruz, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 167 days.

(21) Appl. No.: 18/328,050

(22) Filed: Jun. 2, 2023

(65) Prior Publication Data

US 2023/0313673 A1 Oct. 5, 2023

Related U.S. Application Data

(63) Continuation of application No. 16/672,181, filed on Nov. 1, 2019, now Pat. No. 11,702,926.

(60) Provisional application No. 62/755,119, filed on Nov. 2, 2018.

(51) Int. Cl.

| | |
|---|---|
| ***E21B 47/06*** | (2012.01) |
| ***E21B 34/16*** | (2006.01) |
| ***E21B 47/07*** | (2012.01) |
| ***E21B 47/09*** | (2012.01) |
| ***E21B 47/117*** | (2012.01) |

(52) U.S. Cl.

CPC ..... *E21B 47/06* (2013.01); *E21B 34/16* (2013.01); *E21B 47/07* (2020.05); *E21B 47/09* (2013.01); *E21B 47/117* (2020.05)

(58) Field of Classification Search

CPC ..... E21B 34/16; E21B 23/04; E21B 47/117

See application file for complete search history.

(56) References Cited

U.S. PATENT DOCUMENTS

| | | | | |
|---|---|---|---|---|
| 2002/0027003 | A1 | 3/2002 | Williamson | |
| 2003/0132006 | A1 | 7/2003 | Bussear et al. | |
| 2005/0263279 | A1* | 12/2005 | Vachon | E21B 34/10 166/334.1 |
| 2014/0121973 | A1 | 5/2014 | Buchanan et al. | |

(Continued)

OTHER PUBLICATIONS

International Search Report and Written Opinion of International Patent Application No. PCT/US2019/059422 dated Feb. 25, 2019 (12 pages).

*Primary Examiner* — Cathleen R Hutchins
(74) *Attorney, Agent, or Firm* — Jeffrey D. Frantz

(57) ABSTRACT

A technique facilitates use of sensor data, e.g., pressure data, associated with hydraulic control lines. According to an embodiment, a well string is deployed in a borehole and comprises a tool coupled with a hydraulic control line and operated via hydraulic inputs delivered through the hydraulic control line. Additionally, a sensor is coupled to the hydraulic control line to monitor pressure in the hydraulic control line. The sensor may be located permanently downhole proximate the tool. A control module is configured to collect data from the sensor and to compare the data to a baseline pressure profile associated with the tool. The sensor data may be used to determine characteristics related to operation of the tool.

19 Claims, 8 Drawing Sheets

(56) References Cited

U.S. PATENT DOCUMENTS

| | | | | |
|---|---|---|---|---|
| 2014/0299316 | A1* | 10/2014 | Needham | E21B 47/117 166/250.01 |
| 2015/0107901 | A1 | 4/2015 | Eriksson et al. | |
| 2016/0090833 | A1 | 3/2016 | Samuelson et al. | |
| 2016/0097267 | A1 | 4/2016 | Allen | |
| 2017/0009568 | A1 | 1/2017 | Guelat et al. | |
| 2018/0051535 | A1* | 2/2018 | Wang | E21B 34/10 |
| 2020/0182045 | A1 | 6/2020 | Hill | |

* cited by examiner

Tool Open Profile
(Similar Reverse Profile for Valve Close)

DOWNHOLE MONITORING OF HYDRAULIC EQUIPMENT

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a continuation of U.S. patent application Ser. No. 16/672,181, filed Nov. 1, 2019, now U.S. Pat. No. 11,702,926, which is a Non-Provisional Application claiming priority to U.S. Provisional Application No. 62/755,119, filed Nov. 2, 2018, the entirety of which is incorporated by reference herein and should be considered part of this specification.

BACKGROUND

In many well applications, a well completion is deployed downhole into a wellbore. The well completion may comprise many types of equipment, including hydraulically controlled completions equipment. Traditional hydraulically controlled completions equipment is controlled by hydraulic control lines routed down along the wellbore. For example, the hydraulic control lines may be connected to hydraulic pressure systems located at the subsea tree or surface tree and routed down to hydraulically actuated equipment located in the wellbore.

SUMMARY

In general, a methodology and system are provided for utilizing sensor data, e.g., pressure and/or temperature data, associated with hydraulic control lines. According to some embodiments, a well string is deployed in a borehole and comprises a tool coupled with a hydraulic control line and operated via hydraulic inputs delivered through the hydraulic control line. Additionally, a sensor is coupled to the hydraulic control line to monitor pressure and/or temperature in the hydraulic control line. The sensor is located proximate the tool and may be positioned permanently downhole. A control module is configured to collect data from the sensor and to compare the data to a baseline pressure and/or temperature profile associated with the tool. The sensor data may be used to determine characteristics related to operation of the tool.

However, many modifications are possible without materially departing from the teachings of this disclosure. Accordingly, such modifications are intended to be included within the scope of this disclosure as defined in the claims.

BRIEF DESCRIPTION OF THE FIGURES

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
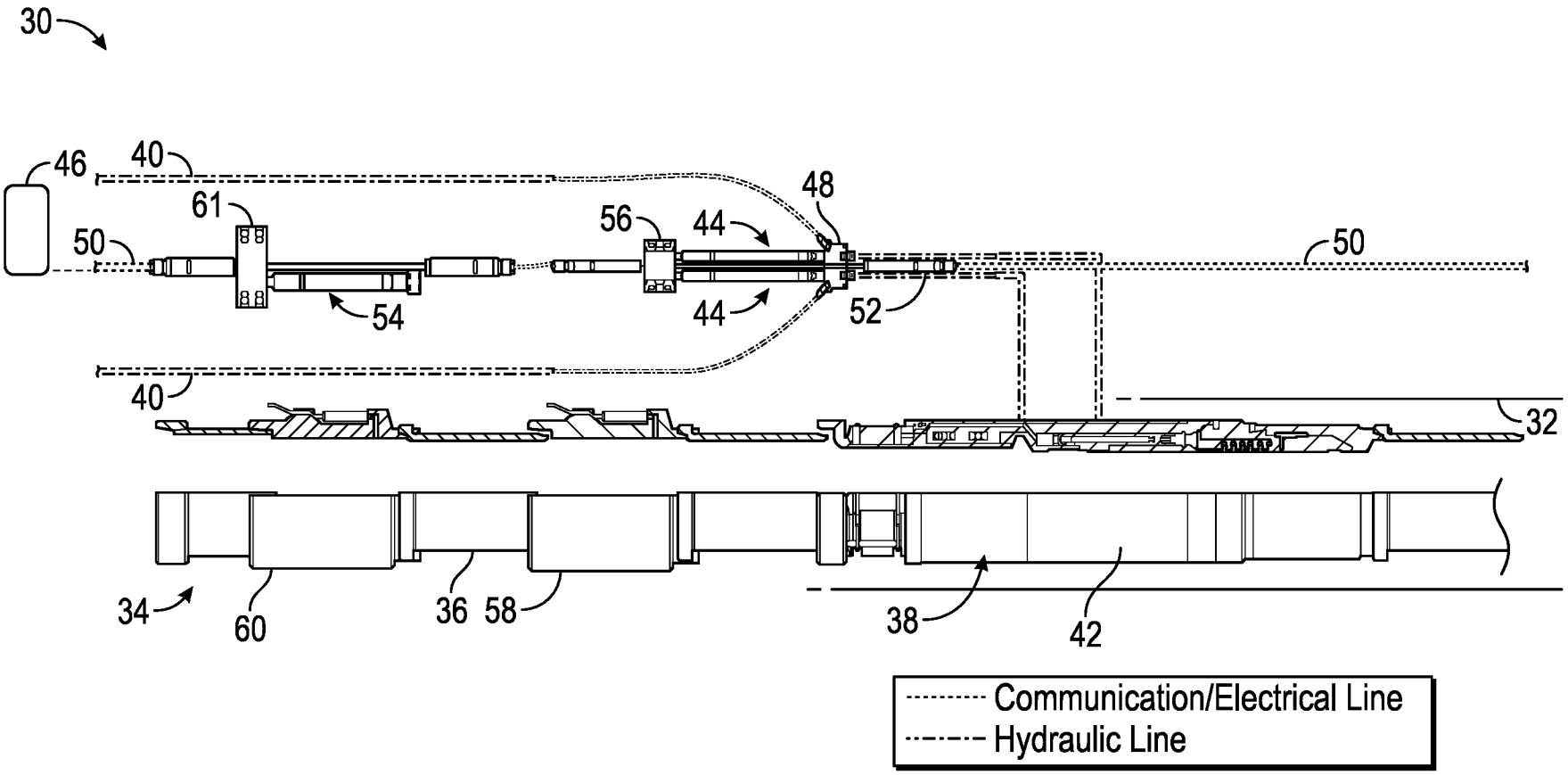
FIG. 1 is an illustration of an example of a well string deployed in a borehole, the well string including a hydraulically actuated tool coupled with at least one sensor located proximate the tool, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system for obtaining and utilizing sensor data, e.g., pressure and/or temperature data, associated with hydraulic control lines. According to an embodiment, a well string is deployed in a borehole and comprises a tool coupled with a hydraulic control line and operated via hydraulic inputs delivered through the hydraulic control line. Depending on the type of downhole tool, the hydraulic control line may comprise a plurality of hydraulic control lines. For example, some types of downhole tools, e.g., certain downhole valves, may be shifted toward open and closed positions, respectively, by a pair of hydraulic control lines.

Additionally, a sensor is coupled to the hydraulic control line to monitor pressure and/or temperature in the hydraulic control line. In some embodiments, the sensor may comprise a plurality of sensors coupled with a corresponding plurality of hydraulic control lines. The sensor is located proximate the tool and may be positioned permanently downhole. For example, the sensor may be coupled to the hydraulic control line less than 100 feet from the tool. In some configurations, the sensor is coupled to or integral with the tool.

A control module is configured to collect data from the sensor(s) and to compare the data to a baseline pressure and/or temperature profile associated with the tool. The sensor data may be used to determine characteristics related to operation of the tool. By placing the sensor downhole in a position proximate the downhole tool, the pressure and/or temperature profile obtained by the sensor provides a relatively detailed pressure and/or temperature signature which can be used to much more accurately identify the characteristics associated with operation of the tool, e.g., to identify problems affecting the health and/or status of the tool. Many types of downhole tools may be operated thousands of feet below the subsea tree or surface tree and this distance tends to attenuate the pressure signal such that the surface pressure signature is of little value in monitoring operational characteristics of the downhole tool.

According to some embodiments, the system may utilize a pressure sensor, e.g., a downhole pressure/temperature gauge of the type that may be used to measure wellbore and/or annulus pressure/temperature. In this type of application, the downhole pressure/temperature gauge is positioned downhole in the well to monitor completions equipment via pressure in the hydraulic control line proximate the location of the completions equipment. The data obtained from the downhole pressure/temperature gauge is then processed to establish the "health" of the completions equipment. If the health of the equipment is known, this knowledge can be used for improved maintenance, troubleshooting, pre-failure identification, and/or other useful evaluation of tool health and/or status. In some embodiments, the completions equipment is in the form of a valve or other suitable downhole tool operated via hydraulic input applied from the surface.

Referring generally to FIG. 1, an example of a well system 30 is illustrated as deployed in a borehole 32, e.g., a wellbore. The well system 30 comprises a well string 34 which may comprise or be in the form of a downhole completion 36 deployed down in wellbore borehole 32. Depending on the application, the well string 34 may be deployed downhole in a vertical and/or deviated, e.g., horizontal, wellbore section.

In the embodiment illustrated, a downhole tool 38 is mounted along the well string 34 and is hydraulically actuated via hydraulic input received through a hydraulic control line 40. In some embodiments, such as the illustrated embodiment, the downhole tool 38 may be coupled with a plurality of the hydraulic control lines 40, e.g., a pair of the hydraulic control lines, to actuate the downhole tool 38 to different operational positions. For example, the downhole tool 38 may be in the form of a valve 42 shiftable via the pair of hydraulic control lines 40 between open flow and closed flow positions respectively. The valve 42 may be in the form of a subsurface safety valve, a flow control valve, or another type of hydraulically actuated valve deployed downhole.

A sensor 44 is coupled to the corresponding hydraulic control line 40 to monitor pressure and/or temperature in the hydraulic control line. The sensor 44 is positioned downhole, proximate the downhole tool 38, to obtain more accurate pressure data indicative of operational characteristics of the downhole tool 38. The positioning of sensor 44 relative to the downhole tool 38 may depend on the distance over which accurate pressure profiles/signatures may be obtained. Generally, sufficiently accurate pressure data may be obtained when the sensor 44 is positioned less than 100 feet from the downhole tool 38.

If more than one hydraulic control line 40 is utilized, a plurality of sensors 44 may be used. For example, an individual sensor 44 may be coupled to each corresponding hydraulic control line 40. Depending on the application, the sensor(s) 44 may be in the form of downhole pressure/temperature gauges such as the type which are normally used to measure wellbore and/or annular pressures and temperatures.

The sensor or sensors 44 may be coupled with a control module 46, e.g., a surface control module. The control module 46 may be a processor-based control module configured to collect data from the sensor(s) 44 and to compare the sensor data to a baseline pressure profile associated with the normal operation of the downhole tool 38. For example, normal operation of the downhole tool 38 at a given position in borehole 32 provides a baseline pressure profile, which may be measured during testing or initial operation of the downhole tool 38. The profile may be stored in the control module 46 for comparison to subsequently collected data from the sensor(s) 44. The control module 46 also may be programmed to output indications of malfunctions or other issues/problems based on comparison of the sensor pressure data collected to the baseline pressure profile as discussed in greater detail below.

The well string 34, downhole tool 38, sensors 44, and other downhole components may have a variety of configurations and arrangements. In the example illustrated, two pressure sensors 44 are coupled with two corresponding hydraulic control lines 40 via a ported connector or block 48. Data from the sensors 44 is provided to the control module 46 via a communication line 50, such as an electric line or other suitable line for carrying the pressure and/or temperature data signals.

In some embodiments, a communication line connector 52 may be used to enable continuation of the communication line 50 down to additional sensors, e.g., gauges, or other electrical components farther downhole. Additional sensors 54 also may be connected along the communication line 50 to obtain desired data on a variety of downhole parameters.

By way of example, the sensors 44 may be mounted directly to components of the well string 34 via mounting brackets 56. In the illustrated example, the sensors 44 are mounted to a multidrop gauge mandrel 58 disposed proximate the downhole tool 38. It should be noted that in FIG. 1 the sensors 44 and corresponding components are pictured as separated from the well string 34 to facilitate explanation, but the sensors 44 may be directly mounted to the multidrop gauge mandrel 58. Similarly, additional sensors 54 may be directly mounted to an additional multidrop mandrel 60 or other suitable well string component via a bracket 61.

Figure 2:
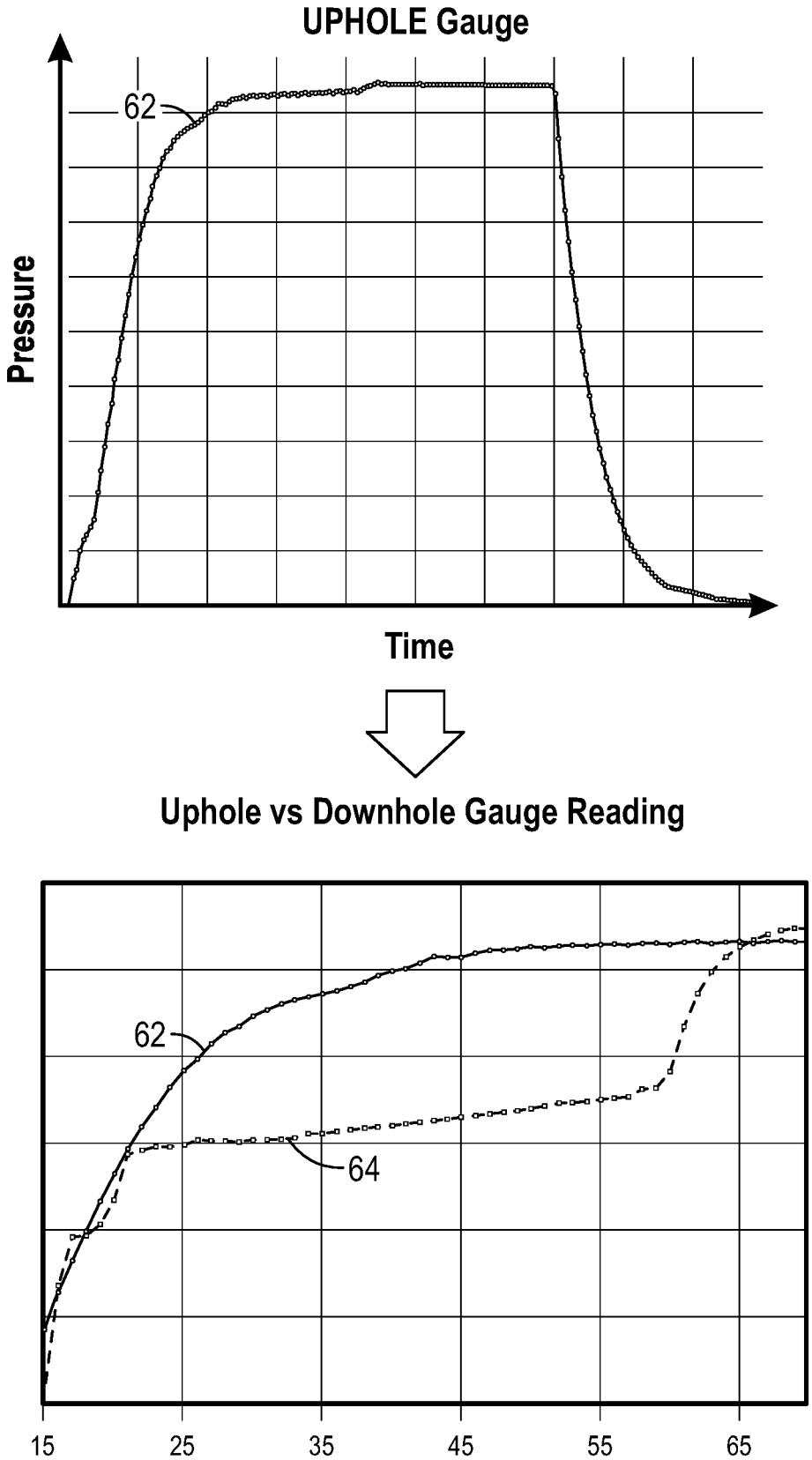
FIG. 2 is a graphical illustration comparing the substantially increased detail of pressure data obtained from a hydraulic control line proximate a downhole tool compared to measurements taken along the hydraulic control line proximate the subsea or surface tree, according to an embodiment of the disclosure.

Referring generally to FIG. 2, examples are provided of the pressure data that may be obtained depending on the location of the corresponding sensor 44. The top graph in FIG. 2 illustrates the limited data that can be detected at the wellhead, e.g., at the subsea tree or surface tree, through potentially thousands of feet of hydraulic control line (see graph line 62). However, the bottom graph in FIG. 2 illustrates the detailed pressure data that can be obtained via the corresponding sensor 44 located proximate, e.g., within 100 feet of, downhole tool 38 (see graph line 64).

This detailed pressure data provides a distinctive pressure signature/profile which can be processed via control module 46 to determine operational characteristics of the downhole tool 38 during operation downhole. For example, the detailed pressure data may be used to determine operational positions of the downhole tool 38 and/or deviations from normal operation of the downhole tool 38, e.g., deviations from a baseline pressure profile associated with the downhole tool 38. Additionally, the pressure signature/profile associated with the graph line 64 can be monitored over time for variation and to perform diagnostics on the desired completions equipment, e.g., downhole tool 38.

Pressure monitoring close to the downhole tool 38 also may be used to provide confirmation that pressure provided at the wellhead is able to reach the downhole tool 38. In other words, data from sensor(s) 44 may be used to verify there are no issues preventing a pressure signal from reaching the downhole tool 38. A blocked hydraulic control line 40 or other flow blockages would cause substantial deviation in the pressure data from sensor(s) 44 relative to the predetermined baseline pressure profile.

By placing the sensor or sensors 44 proximate the downhole tool 38, substantial noise reduction is achieved in the sensor data compared to data that would be received at the wellhead. This enables detailed analysis of the operation of downhole tool 38 and allows for equipment diagnostics so as to help identify the current "health" of the downhole tool 38.

Figure 3:
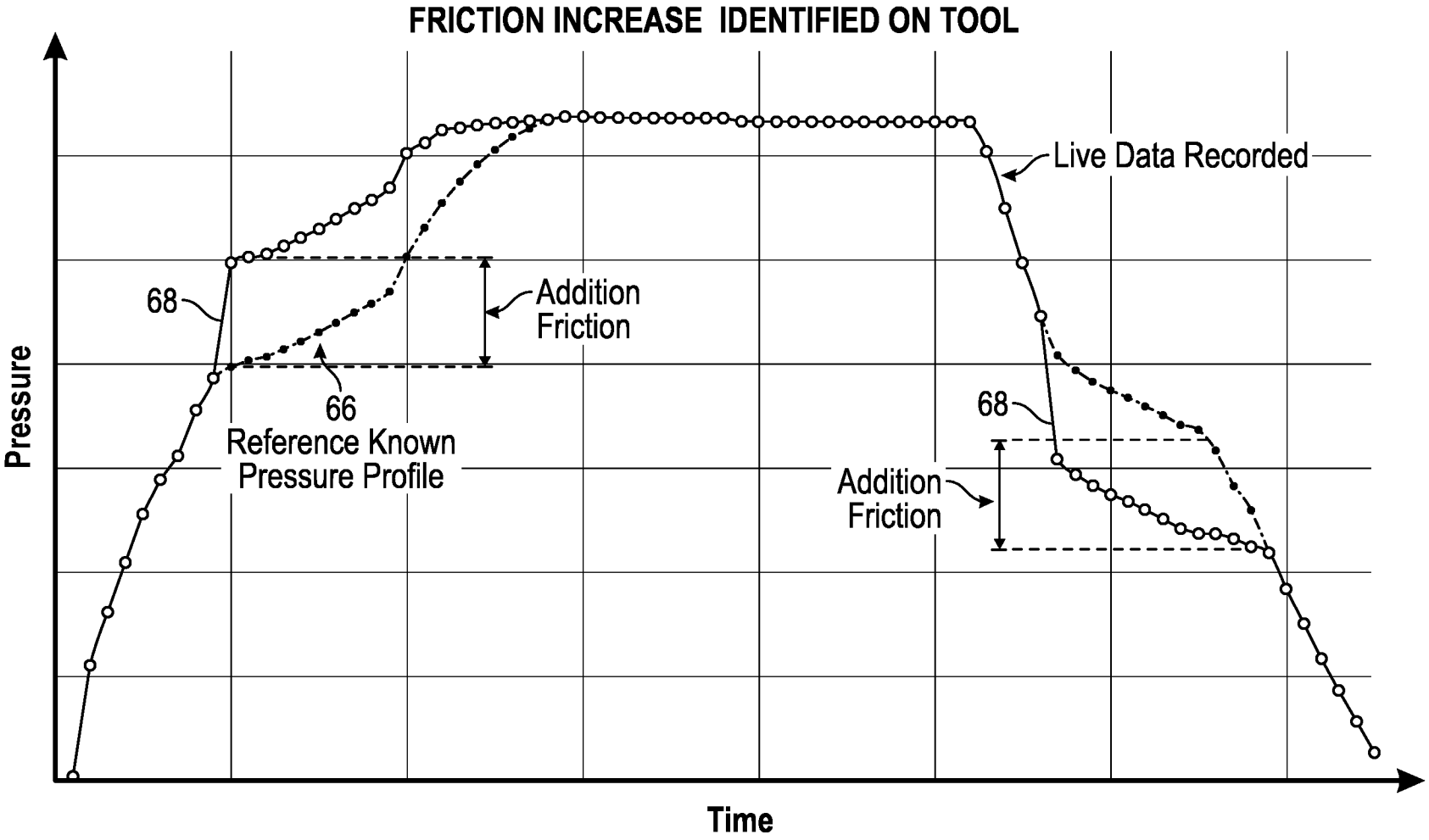
FIG. 3 is a graphical illustration showing deviations from a baseline pressure profile associated with a downhole tool, according to an embodiment of the disclosure.

Referring generally to FIG. 3, a graphical example is provided of pressure monitoring via sensors 44 located proximate downhole tool 38, e.g., less than 100 feet from downhole tool 38. In this example, a baseline pressure profile 66 has been established for the associated downhole tool 38, e.g., valve 42. Deviations from the baseline pressure profile 66, indicated by graph line portions 68, represent additional friction resisting operation of the downhole valve 42. Such additional friction may be an indicator of the presence of precipitates on the downhole valve 42 which inhibit proper operation of the valve 42. If the buildup of precipitates can be identified, a well operator is able to efficiently schedule interventions, chemical treatments, and/or other operations to bring the operating profile of the valve 42 (or other downhole device tool 38) back into an acceptable range. This early action can help prevent premature failure of the equipment.

A comparison of the pressure data obtained from the sensors 44 with the baseline pressure profile 66 also can be used to identify many types of downhole tool operational characteristics. Examples of identification of operational characteristics include identifying the correct application of pressure (e.g., the correct application of pressure to fully open/close a valve); correct piston actuation profile (e.g., identification of appropriate force for actuating a piston of the downhole tool 38); and correct piston travel length (e.g., confirming parts, e.g., an indexer, of the downhole tool 38 are not stuck or limited by unequalized pressure).

The comparison of pressure data from sensors 44 to the baseline pressure profile 66 also may be used to determine excessive wear; leaks in the hydraulic control lines 40; plugging of the hydraulic control lines 40 (e.g., plugging due to sand, hydrates, debris, or control line deformation); and the correct termination of control lines. It should be noted that sensors 44 may comprise pressure/temperature sensors or other types of sensors able to monitor temperature which also can be used to determine operational characteristics of the downhole tool 38. For example, an increase in temperature may be an indication of excessive component wear in downhole tool 38.

Figure 4:
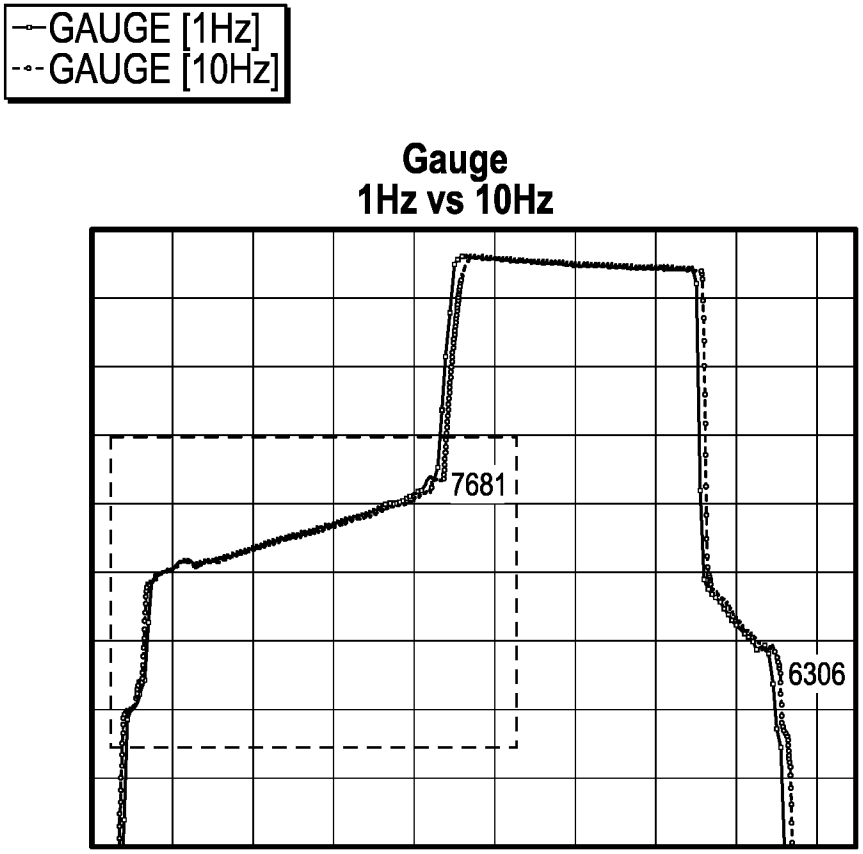
FIGS. 4 and 5 are graphical illustrations showing that increasing recording rate can increase data resolution.
Figure 5:
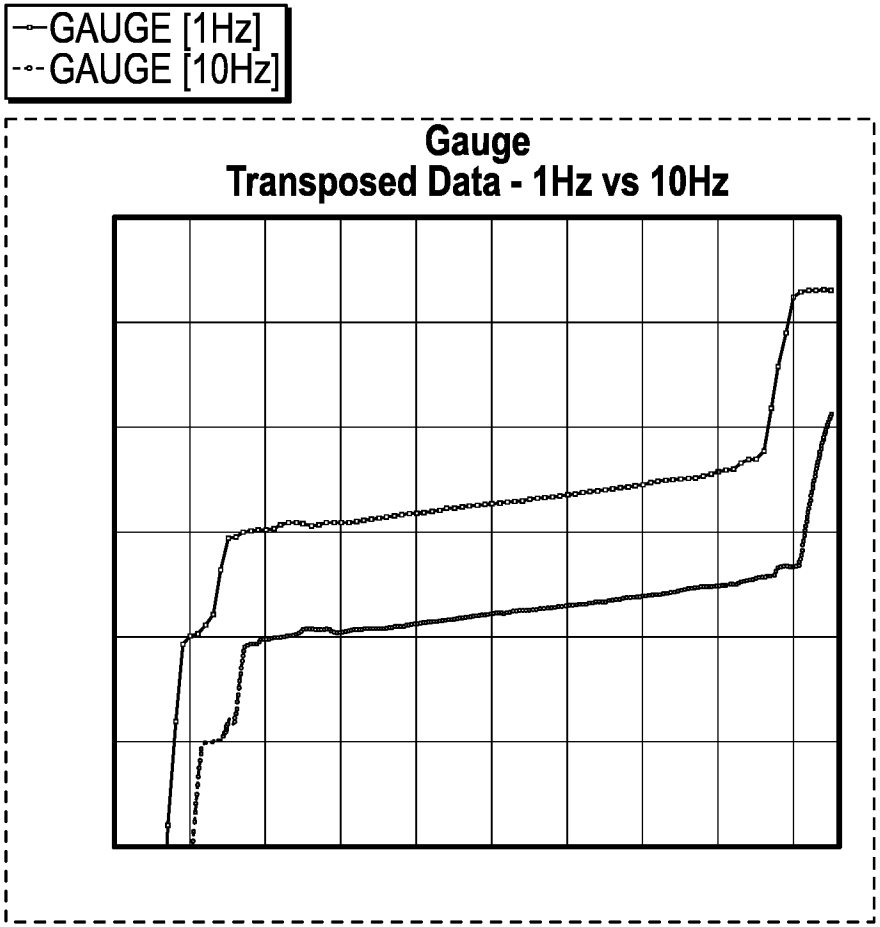

Referring generally to FIGS. 4 and 5, the resolution of the data from the sensor(s) can be increased by increasing the recording rate (in Hz).

Figure 6:
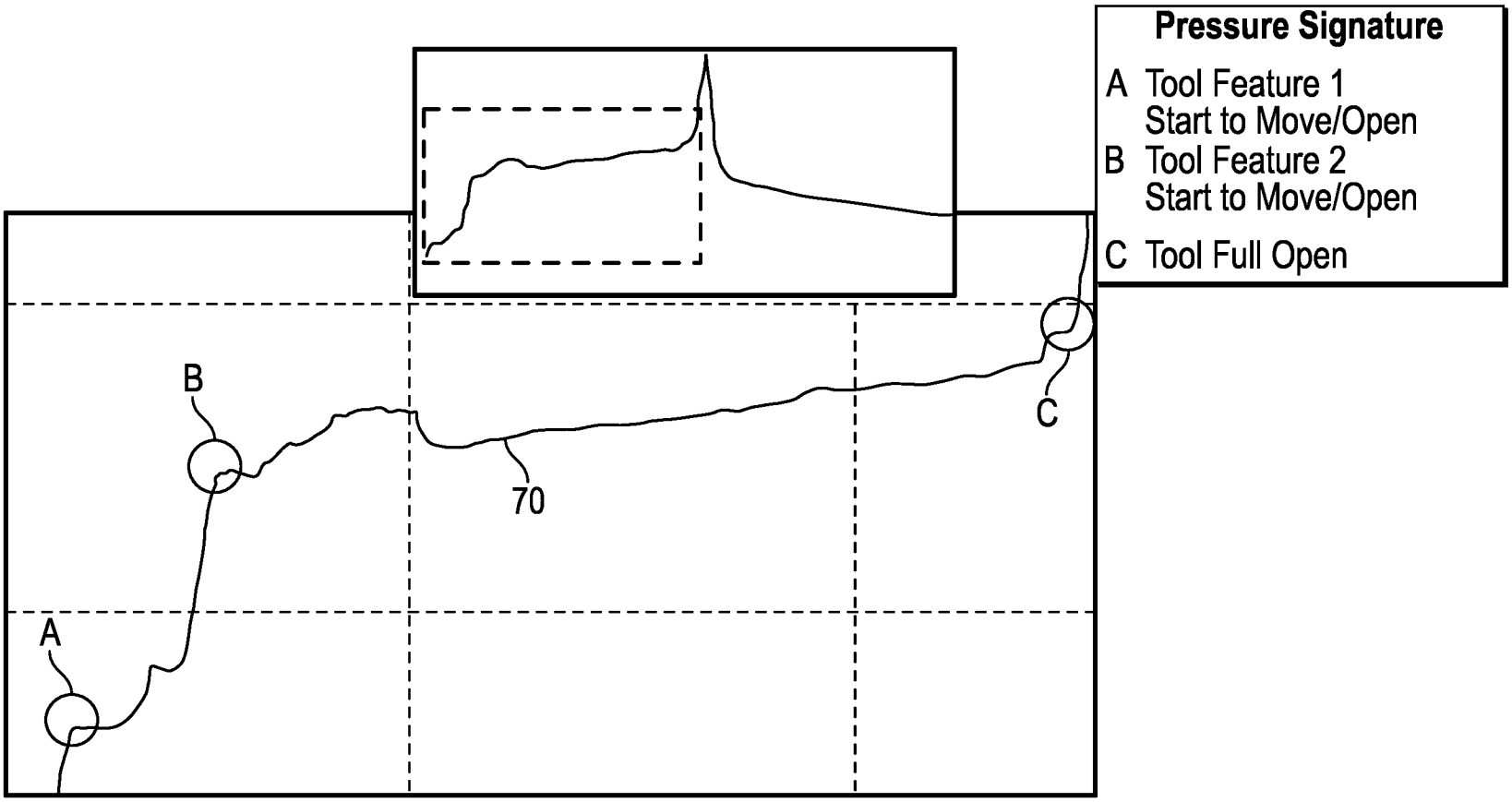
FIG. 6 is a graphical illustration of a pressure signature of a downhole tool, according to an embodiment of the disclosure.

Referring generally to FIG. 6, another graphical illustration is provided of pressure data obtained via pressure sensors 44 located proximate the downhole tool 38. In this example, the downhole tool 38 is again in the form of valve 42 and the graphical illustration represents a pressure profile/signature 70 measured via the sensors 44. The pressure profile/signature 70 comprises a variety of changes or features indicative of corresponding characteristics associated with operation of the valve 42. Examples of such operational characteristics are labeled along the pressure profile/signature 70 via letters A, B, C.

By understanding the appropriate baseline pressure data which corresponds with operational characteristics, tool positions can be determined. Additionally, deviations from that baseline can be used as an indicator of the health and/or status of the valve 42 (or other downhole tool 38). For example, deviations from this baseline can be used to identify problems, e.g., malfunctions, or other abnormalities affecting operation of the valve 42.

Figure 7A:
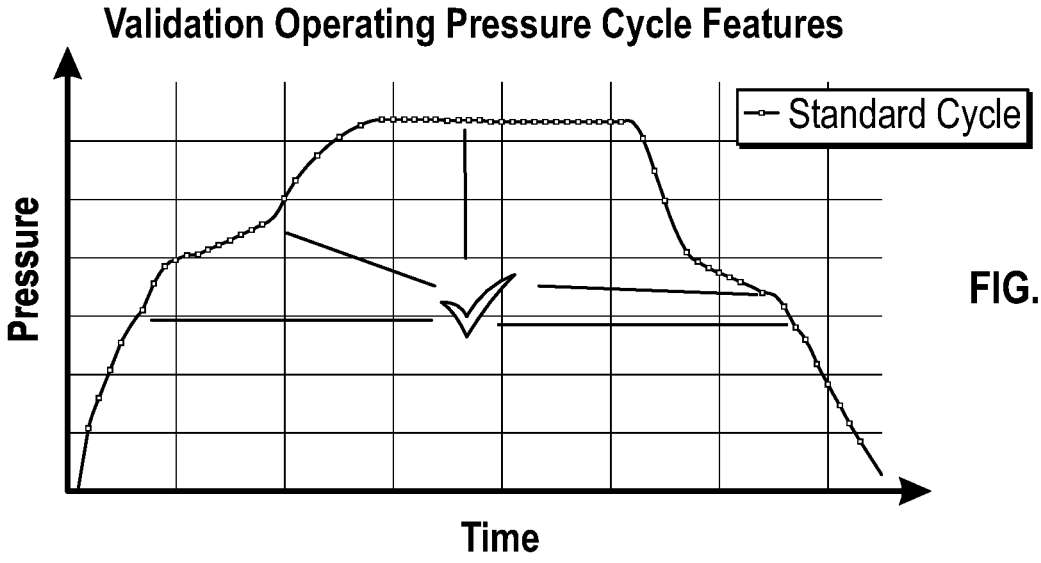
FIGS. 7A-7E are graphical illustrations showing a series of graphs reflecting a baseline pressure profile and various deviations from that profile, according to an embodiment of the disclosure.
Figure 7B:
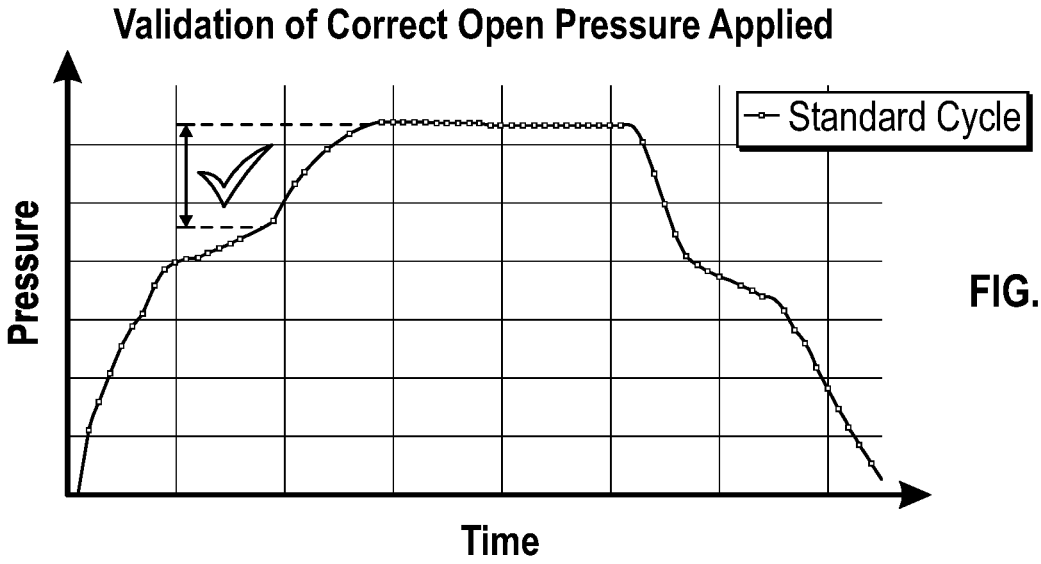
Figure 7C:
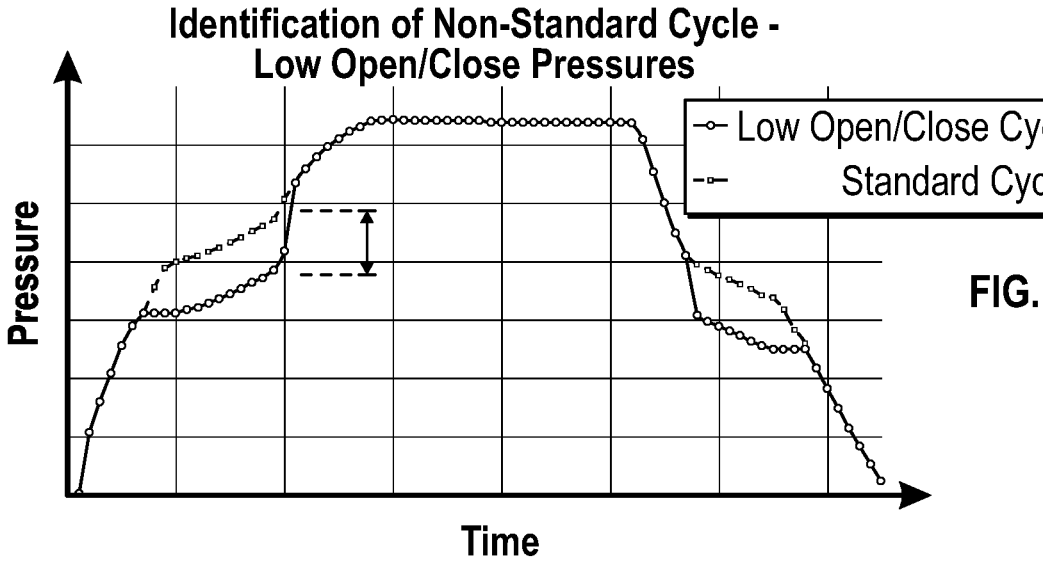
Figure 7D:
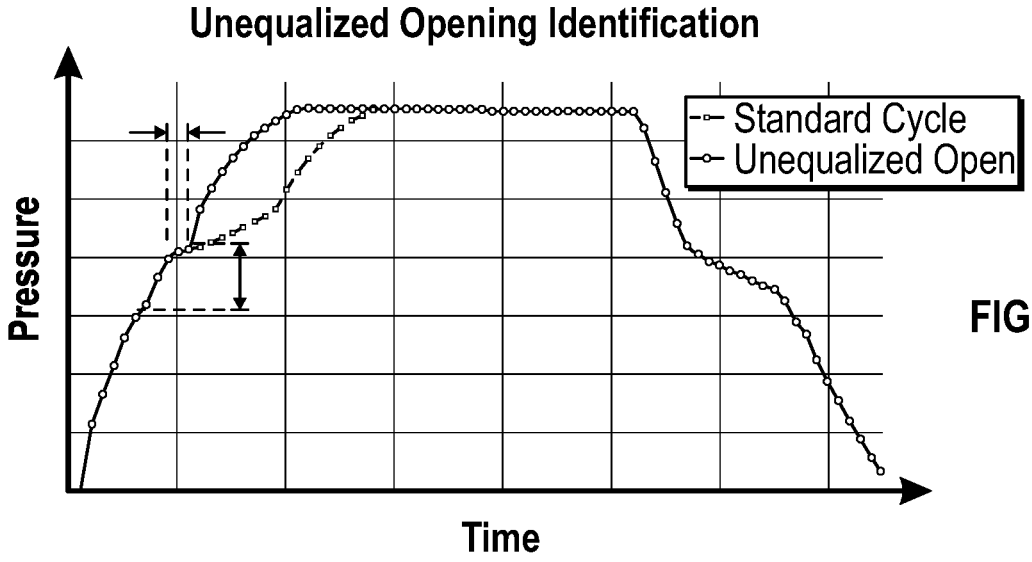
Figure 7E:
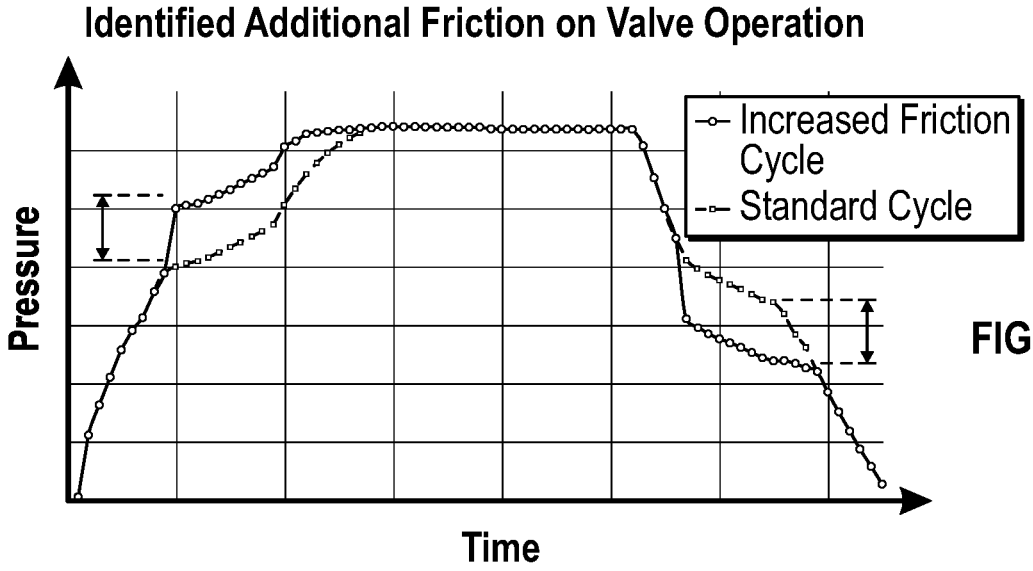

The comparison between pressure data (obtained by the locally positioned sensors 44) and the predetermined baseline pressure profile can provide many types of indications regarding the health, status, and/or position of a given downhole tool. Several graphical examples are provided in FIGS. 7A-7E which show a baseline pressure profile for a valve 42 (see FIG. 7A) and operational characteristics of that valve 42. The operational characteristics may relate to operational positions of the valve 42 (see FIG. 7B) and/or to a variety of operational characteristics indicating problems associated with actuation of the valve 42 (see FIGS. 7C-7E).

The ability to monitor operational characteristics related to appropriate operation and problematic operation of the downhole tool 38 enables an improved ongoing monitoring of the health of the downhole tool 38. The data from sensors 44 may be provided continuously to control module 46 which may be programmed to recommend and/or initiate corrective actions. The corrective actions may be selected to improve the operational life of the downhole tool 38 and the overall well string 34.

Figure 8:
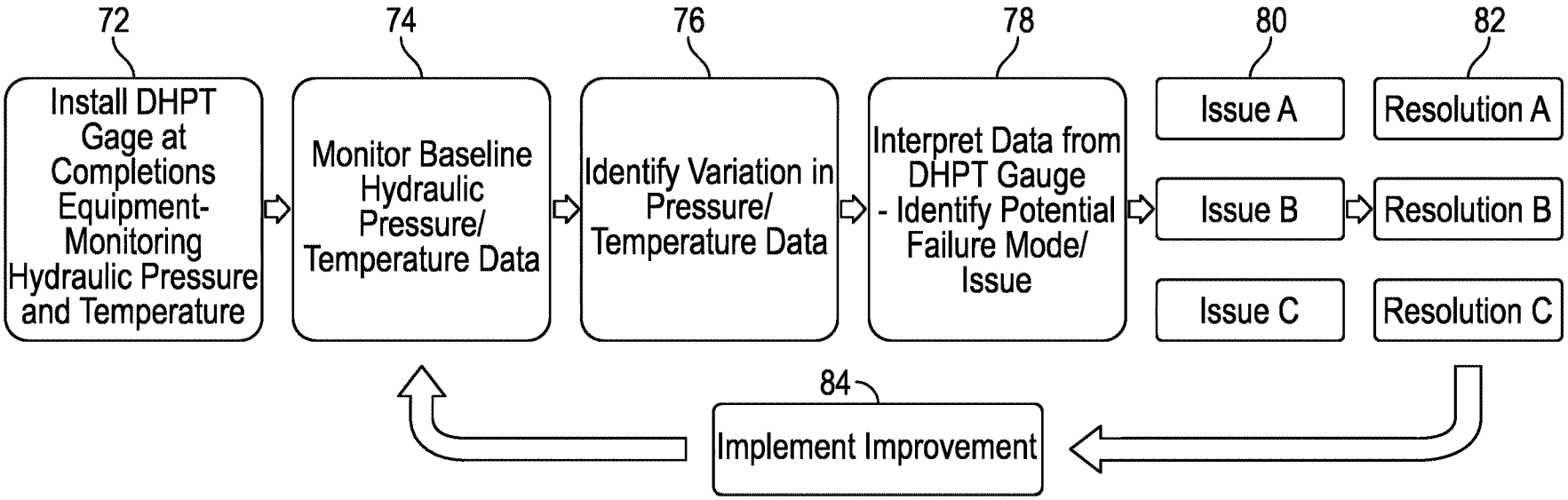
FIG. 8 is flowchart illustrating an example of a procedure for monitoring pressure data and for taking actions based on the pressure data, according to an embodiment of the disclosure.

Referring generally to FIG. 8, a flow chart is provided to illustrate an example of performance health monitoring with respect to downhole tool 38. As represented by block 72, the sensor or sensors 44, e.g., permanent downhole pressure-temperature gauges, are initially installed proximate the downhole tool 38. The sensor(s) 44 are coupled with the corresponding hydraulic control line(s) 40 to monitor hydraulic pressure. In some embodiments, the sensors 44 may be used to monitor additional parameters, such as temperature.

Each sensor 44 provides hydraulic pressure data (and sometimes additional data such as temperature) to the control module 46, as represented by block 74. This data is then compared to a baseline profile and points of interest and/or deviations from the baseline profile are identified by the control module 46, as represented by block 76.

The control module 46 may be programmed to interpret the data received from sensors 44 and to identify potential failure modes or other operational characteristics related to operation of downhole tool 38, as represented by block 78. Once identified, the control module 46 may output an indication of the issue or issues of interest related to operation of downhole tool 38, as represented by blocks 80. In some embodiments, the control module 46 may be programmed to output and/or implement resolutions with respect to the operational characteristics/issues identified, as represented by blocks 82. After implementation of the resolution(s) to improve operation of downhole tool 38, the sensor(s) 44 continue to monitor the downhole tool 38 from a downhole position proximate the tool, as represented by block 84.

Depending on the characteristics of a given application and environment, well system 30 may have many types of configurations. For example, the well system 30 may utilize many types of completions equipment and downhole tools 38. Additionally, various types of sensors 44 may be coupled with hydraulic control lines 40 at selected positions proximate the corresponding downhole tool 38, e.g., at positions within 100 feet of the downhole tool 38. In some embodiments, the sensors 44 may be constructed to measure other parameters, e.g., temperature, or the sensors 44 may be combined with various types of additional sensors. The control module 46 may be located at the wellhead or at a variety of surface locations. Furthermore, the control module 46 may comprise various types of computer-based control systems programmable to evaluate pressure data, to compare the pressure data to baseline pressure data, and to identify abnormalities or points of interest with respect to the pressure data. In some embodiments, the control module 46 may be programmed to automatically implement various corrective actions with respect to issues identified.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method comprising:

receiving a first indication of at least one of pressure or temperature in a hydraulic control line coupled to a downhole tool from a sensor disposed proximate to the downhole tool, the first indication of the at least one of the pressure or the temperature in the hydraulic control line corresponding to at least a respective one of a baseline pressure profile or a baseline temperature profile associated with normal operation of the downhole tool;

receiving a second indication of the at least one of the respective pressure or temperature in the hydraulic control line coupled to the downhole tool from the sensor;

utilizing (i) the second indication of the at least one of the respective pressure or temperature in the hydraulic control line and (ii) the at least one of the respective baseline pressure profile or the baseline temperature profile associated with the downhole tool to determine one or more operational characteristics of the downhole tool, the one or more operational characteristics of the downhole tool indicating a precipitate buildup; and in response to the indication of the precipitate buildup, initiating one or more well intervention operations to remove the precipitate buildup.

2. The method of claim 1, wherein receiving the first indication from the sensor proximate to the downhole tool comprises receiving the first indication from the sensor disposed at a distance of less than 100 feet from the downhole tool.

3. The method of claim 1, further comprising utilizing the second indication to monitor operational positions of the downhole tool.

4. The method of claim 1, further comprising utilizing the second indication to determine one or more leaks in the hydraulic control line.

5. The method of claim 1, wherein the one or more well intervention operations to remove the precipitate includes performing one or more chemical treatments to remove the precipitate buildup.

6. The method of claim 1, further comprising:

determining a valve application pressure of a downhole safety valve of the downhole tool based on the one or more operational characteristics, wherein the valve application pressure includes at least one of a correct pressure to fully open the downhole safety valve or a correct pressure to fully close the downhole safety valve; and controlling the downhole safety valve, via the hydraulic control line, according to the determined valve application pressure.

7. The method of claim 1, further comprising:

determining a valve application pressure of a flow control valve of the downhole tool based on the one or more operational characteristics, wherein the valve application pressure includes at least one of a correct pressure to fully open the flow control valve or a correct pressure to fully close the flow control valve; and controlling the flow control valve, via the hydraulic control line, according to the determined valve application pressure.

8. The method of claim 1, wherein the one or more operational characteristics of the downhole tool indicates a malfunction or potential failure of the downhole tool, and the method further comprises outputting an indication of the malfunction or potential failure to a display.

9. The method of claim 1, further comprising:

determining a piston actuation profile based on the one or more operational characteristics; and controlling the piston, via the hydraulic control line, according to the determined piston actuation profile.

10. A system, comprising:

a downhole tool coupled with a hydraulic control line and operated via hydraulic inputs delivered through the hydraulic control line;

a downhole sensor coupled to the hydraulic control line to monitor at least one of pressure or temperature in the hydraulic control line, the sensor being located proximate the downhole tool; and a processor-based control module when in operation is configured to:

collect at least one of pressure data or temperature data from the sensor;

compare the at least one of the pressure data or the temperature data to at least a respective one of a baseline pressure profile or a baseline temperature profile associated with normal operation of the downhole tool;

determine one or more operational characteristics of the downhole tool based on a comparison of the at least one of the respective pressure data or temperature data to the at least the respective one of the baseline pressure profile or the baseline temperature profile, the one or more operational characteristics of the downhole tool indicating a precipitate buildup; and in response to the indication of the precipitate buildup, initiate one or more well intervention operations to remove the precipitate buildup.

11. The system of claim 10, wherein the hydraulic control line comprises a plurality of hydraulic control lines, wherein the sensor comprises a plurality of sensors, and wherein each sensor of the plurality of sensors is coupled to a respective hydraulic control line of the plurality of hydraulic control lines.

12. The system of claim 10, further comprising:

determining a valve application pressure of a downhole safety valve of the downhole tool based on the one or more operational characteristics, wherein the valve application pressure includes at least one of a correct pressure to fully open the downhole safety valve or a correct pressure to fully close the downhole safety valve; and controlling the downhole safety valve, via the hydraulic control line, according to the determined valve application pressure.

13. The system of claim 10, wherein the processor-based control module is a surface control module.

14. The system of claim 10, wherein the processor-based control module when in operation is further configured to output an indication of a problem with respect to actuation of the downhole tool.

15. The system of claim 10, wherein the processor-based control module when in operation is further configured to output an indication of a deviation of the operating characteristic of the downhole tool relative to the at least the respective one of the baseline pressure profile or the baseline temperature profile.

16. The system of claim 15, wherein the processor-based control module when in operation outputs an indication of the precipitate buildup as the indication of the deviation of the operating characteristic of the downhole tool relative to the at least the respective one of the baseline pressure profile or the baseline temperature profile.

17. A method, comprising:

determining at least one of a baseline pressure profile or a baseline temperature profile corresponding to normal operation of a downhole tool based on at least a respective one of pressure measurements or temperature measurements of a hydraulic control line associated with the downhole tool;

monitoring the at least the respective one of the pressure or the temperature of the hydraulic control line via one or more sensors disposed proximate to the downhole tool;

transmitting data indicative of the at least the respective one of the pressure or the temperature of the hydraulic control line from the sensor;

identifying deviations of the data indicative of the at least the respective one of the pressure or the temperature of the hydraulic control line with respect to the at least a respective one of the baseline pressure profile or the baseline temperature profile to determine one or more operational characteristics of the downhole tool during downhole operation of the downhole tool, the one or more operational characteristics of the downhole tool indicating a precipitate buildup; and in response to the indication of the precipitate buildup, initiating one or more well intervention operations to remove the precipitate buildup.

18. The method of claim 17, one or more well intervention operations to remove the precipitate buildup includes performing one or more chemical treatments to remove the precipitate buildup.

19. The method of claim 17, further comprising determining a malfunction of the downhole tool based upon the one or more operational characteristics.

* * * * *